US011360412B2

(12) United States Patent
Kato

(10) Patent No.: US 11,360,412 B2
(45) Date of Patent: Jun. 14, 2022

(54) IMAGING SYSTEM

(71) Applicant: HEWLETT-PACKARD DEVELOPMENT COMPANY, L.P., Spring, TX (US)

(72) Inventor: Yuya Kato, Kanagawa (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/256,533

(22) PCT Filed: Oct. 2, 2019

(86) PCT No.: PCT/US2019/054197

§ 371 (c)(1),
(2) Date: Dec. 28, 2020

(87) PCT Pub. No.: WO2020/081231

PCT Pub. Date: Apr. 23, 2020

(65) Prior Publication Data

US 2021/0278783 A1 Sep. 9, 2021

(30) Foreign Application Priority Data

Oct. 19, 2018 (JP) ..... JP2018-197627

(51) Int. Cl.
*G03G 15/04* (2006.01)
*G03G 15/10* (2006.01)
*G03G 21/16* (2006.01)

(52) U.S. Cl.
CPC ..... *G03G 15/104* (2013.01); *G03G 21/1676* (2013.01)

(58) Field of Classification Search
CPC ..... G03G 15/0822; G03G 15/0865; G03G 15/0891; G03G 15/104; G03G 21/1676; G03G 2215/0668
USPC ..... 399/107, 110, 119, 120
See application file for complete search history.

(56) References Cited

U.S. PATENT DOCUMENTS 7,340,188 B2 3/2008 Yamada et al.
7,925,190 B2 * 4/2011 Matsumoto ..... G03G 15/0865 399/258
8,855,525 B2 * 10/2014 Muto ..... G03G 15/0808 399/103
8,923,726 B2 12/2014 Tsuda et al.
2003/0091363 A1 5/2003 Hoffman et al.
(Continued)

FOREIGN PATENT DOCUMENTS

JP 2004272144 A 9/2004
JP 2011197442 A 10/2011

*Primary Examiner* — Hoan H Tran
(74) *Attorney, Agent, or Firm* — Trop Pruner & Hu, P.C.

(57) ABSTRACT

An imaging system includes a casing with a developing chamber, a developing roller which is located inside the developing chamber and which carries a toner, and a conveying path which is located adjacent to the developing chamber inside the casing and is used to circulate the toner and to supply the toner to the developing roller. A discharge path includes an inlet, an outlet, and an intermediate portion between the inlet and the outlet. The inlet communicates with the developing chamber in the casing and is located outside the conveying path. The outlet is located between the developing roller and a photoreceptor. The intermediate portion is located outside the casing.

20 Claims, 11 Drawing Sheets

(56) References Cited

U.S. PATENT DOCUMENTS

| | | | |
|---|---|---|---|
| 2004/0083887 | A1 | 5/2004 | Simpson et al. |
| 2004/0245711 | A1 | 12/2004 | Domoto et al. |
| 2011/0211859 | A1 | 9/2011 | Shimoyama et al. |
| 2015/0093139 | A1 | 4/2015 | Kuramoto et al. |

* cited by examiner

IMAGING SYSTEM

BACKGROUND

An image forming device includes a photoreceptor, a charging device, an exposure device which forms an electrostatic latent image on the photoreceptor, a developing device which develops the electrostatic latent image by applying a toner thereto, and a transfer device which transfers the toner image on the photoreceptor to a transfer material.

DETAILED DESCRIPTION

In the following description, with reference to the drawings, the same reference numbers are assigned to the same components or to similar components having the same function, and overlapping description is omitted. Further, the dimensional ratios of the drawings may not be limited to the ratios of the drawings. Hereinafter, example imaging systems will be described with reference to the drawings. The imaging systems may comprise, for example, an imaging apparatus such as a printer or a part of the imaging apparatus (for example, a developing system or the like).

Configuration of an Example Imaging Apparatus

Figure 1:
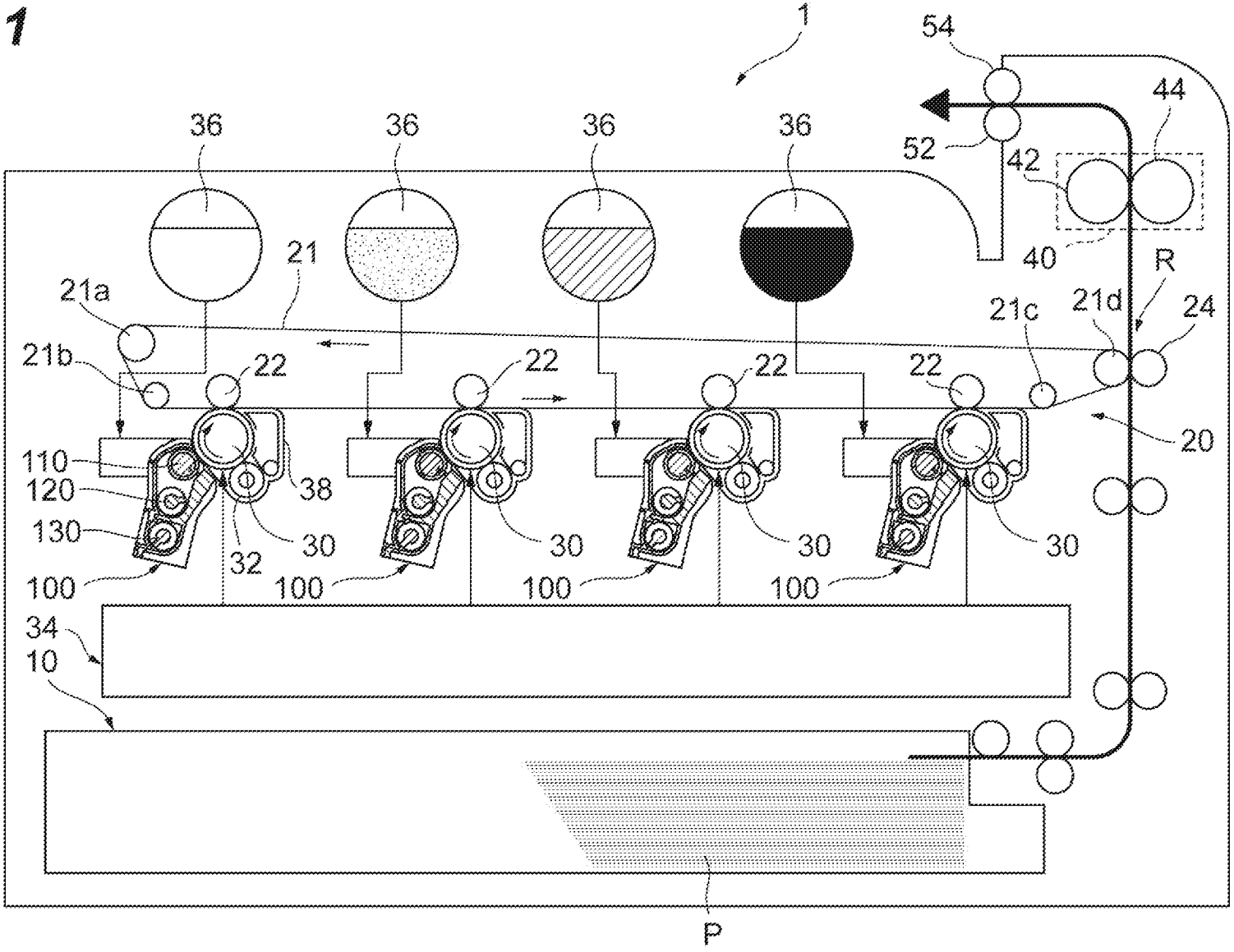
FIG. 1 is a schematic diagram illustrating a configuration of an example imaging apparatus.

As illustrated in FIG. 1, an example imaging apparatus 1 may include a recording medium conveying unit 10 (e.g., a conveying device), a transfer unit 20 (e.g., a transfer device), a photoreceptor drum (e.g., a photoreceptor) 30, four developing devices 100, and a fixing unit 40 (e.g., a fixing device).

The recording medium conveying unit 10 accommodates a sheet P which is a recording medium having an image formed thereon. Further, the recording medium conveying unit 10 conveys the sheet P on a recording medium conveying path. The sheet P is stacked in a cassette. The recording medium conveying unit 10 is configured to convey the sheet P to a secondary transfer region R at a timing in which a toner image transferred to the sheet P reaches the secondary transfer region R.

The transfer unit 20 conveys the toner image formed by the photosensitive drum 30 to the secondary transfer region R in which the toner image is secondarily transferred to the sheet P. The transfer unit 20 includes, for example, a transfer belt 21, suspension rollers 21*a*, 21*b*, 21*c*, and 21*d* which suspend the transfer belt 21, a primary transfer roller 22 which sandwiches the transfer belt 21 along with the photosensitive drum 30, and a secondary transfer roller 24 which sandwiches the transfer belt 21 along with the suspension roller 21*d*.

The transfer belt 21 may include an endless belt which is moved in a circulating manner by the suspension rollers 21*a*, 21*b*, 21*c*, and 21*d*. The primary transfer roller 22 may be configured to press the photosensitive drum 30 from the inner peripheral side of the transfer belt 21. The secondary transfer roller 24 may be configured to press the suspension roller 21*d* from the outer peripheral side of the transfer belt 21. The transfer unit 20 may further include a belt cleaning device or the like which removes a toner adhering to the transfer belt 21.

The photosensitive drum 30 may comprise an electrostatic latent image carrier having an image formed on a peripheral surface thereof. The photosensitive drum 30 may be, for example, an Organic Photo Conductor (OPC). The example imaging apparatus 1 may comprise an apparatus configured to form a color image. In some examples, four photosensitive drums 30 respectively corresponding to yellow, magenta, cyan, and black colors may be located along the movement direction of the transfer belt 21. As illustrated in FIG. 1, a charging roller 32, an exposure unit 34 (e.g., an exposure device), a developing device 100, and a cleaning unit 38 (e.g., a cleaning device) may be respectively located on the circumference of each photosensitive drum 30.

The charging roller 32 uniformly charges a surface of the photosensitive drum 30 to a predetermined potential. The exposure unit 34 exposes the surface of the photosensitive drum 30 charged by the charging roller 32 in response to an image formed on the sheet P. Accordingly, a potential of a portion exposed by the exposure unit 34 in the surface of the photosensitive drum 30 changes so that an electrostatic latent image is formed. A separate toner tank 36 may be associated with each of the (e.g., four) developing devices 100. The developing device 100 generates a toner image by developing the electrostatic latent image formed on the photosensitive drum 30 by the toner. In some examples, four toner tanks 36 are respectively filled with a replenishment developer obtained by mixing yellow, magenta, cyan, and black toner and carriers.

The cleaning unit 38 collects the toner remaining on the photosensitive drum 30 after the toner image on the photosensitive drum 30 is initially transferred to the transfer belt 21. The cleaning unit 38 may remove the residual toner on the photosensitive drum 30 by bringing a cleaning blade into contact with, for example, the peripheral surface of the photosensitive drum 30. Furthermore, a charge elimination lamp which resets a potential of the photosensitive drum 30 may be located between the cleaning unit 38 and the charging roller 32 in the rotational direction of the photosensitive drum 30 on the circumference of the photosensitive drum 30.

The fixing unit 40 fixes the toner image secondarily transferred from the transfer belt 21 to the sheet P to the sheet P. The fixing unit 40 includes, for example, a heating roller 42 and a pressing roller 44. The heating roller 42 is a cylindrical member that is rotatable about a rotary shaft. For example, a heat source such as a halogen lamp may be located inside the heating roller 42. The pressing roller 44 is a cylindrical member that is rotatable about a rotary shaft. The pressing roller 44 may be configured to press the heating roller 42. For example, a thermal resistant elastic layer such as silicon rubber may be located on the outer peripheral surfaces of the heating roller 42 and the pressing roller 44. The sheet P is caused to pass through a fixing nip portion which is a contact region between the heating roller 42 and the pressing roller 44 so that the toner image is heated and fixed to the sheet P.

Further, the imaging apparatus 1 may comprise discharge rollers 52 and 54 for discharging the sheet P to which the toner image is fixed by the fixing unit 40 to the outside of the apparatus.

Next, an example operation of the example imaging apparatus 1 will be described. When an image signal of a recording target image is input to the imaging apparatus 1, the control unit of the imaging apparatus 1 uniformly charges the surfaces of the photosensitive drum 30 to a predetermined potential by the charging roller 32. Then, the control unit of the imaging apparatus 1 forms an electrostatic latent image by irradiating a laser beam to the surface of the photosensitive drum 30 by the exposure unit 34 on the basis of the received image signal.

The developing device 100 mixes and stirs the toner and the carrier by adjusting the toner and the carrier to a predetermined mixing ratio. The developing device 100 adjusts the developer by uniformly dispersing the toner to apply an optimal charging amount. The adjusted developer is carried (held) by the developing roller 110. Then, when the developer is conveyed to a region (a supply position) facing the photosensitive drum 30 by the rotation of the developing roller 110, the toner in the developer carried on the developing roller 110 moves to the electrostatic latent image formed on the peripheral surface of the photosensitive drum 30 so that the electrostatic latent image is developed. The toner image which is formed in this way is initially transferred from the photosensitive drum 30 to the transfer belt 21 in a region in which the photosensitive drum 30 faces the transfer belt 21. The toner images formed on four photosensitive drums 30 are sequentially superimposed on the transfer belt 21 so that one composite toner image is formed. Then, the composite toner image may be secondarily transferred to sheet P conveyed from the recording medium conveying unit 10 in the secondary transfer region R in which the suspension roller 21*d* faces the secondary transfer roller 24.

The sheet P to which the composite toner image is secondarily transferred is conveyed to the fixing unit 40. When the sheet P is caused to pass between the heating roller 42 and the pressing roller 44 while applying a heat and a pressure thereto, the composite toner image is fused or otherwise fixed to the sheet P. Then, the sheet P is discharged to the outside of the imaging apparatus 1 by the discharge rollers 52 and 54. For imaging systems including a belt cleaning device, the toner remaining on the transfer belt 21 after the composite toner image is secondarily transferred to the sheet P may be removed by the belt cleaning device.

Configuration of an Example Developing Device

A schematic configuration of the example developing device 100 will be described. The developing device 100 uses, for example, a two-component developer including a toner and a carrier as the developer. Further, in order to prolong the life of the developer, the developing device 100 discharges an old developer from a developer discharge port and replenishes a new developer into a developer storage chamber.

Figure 2:
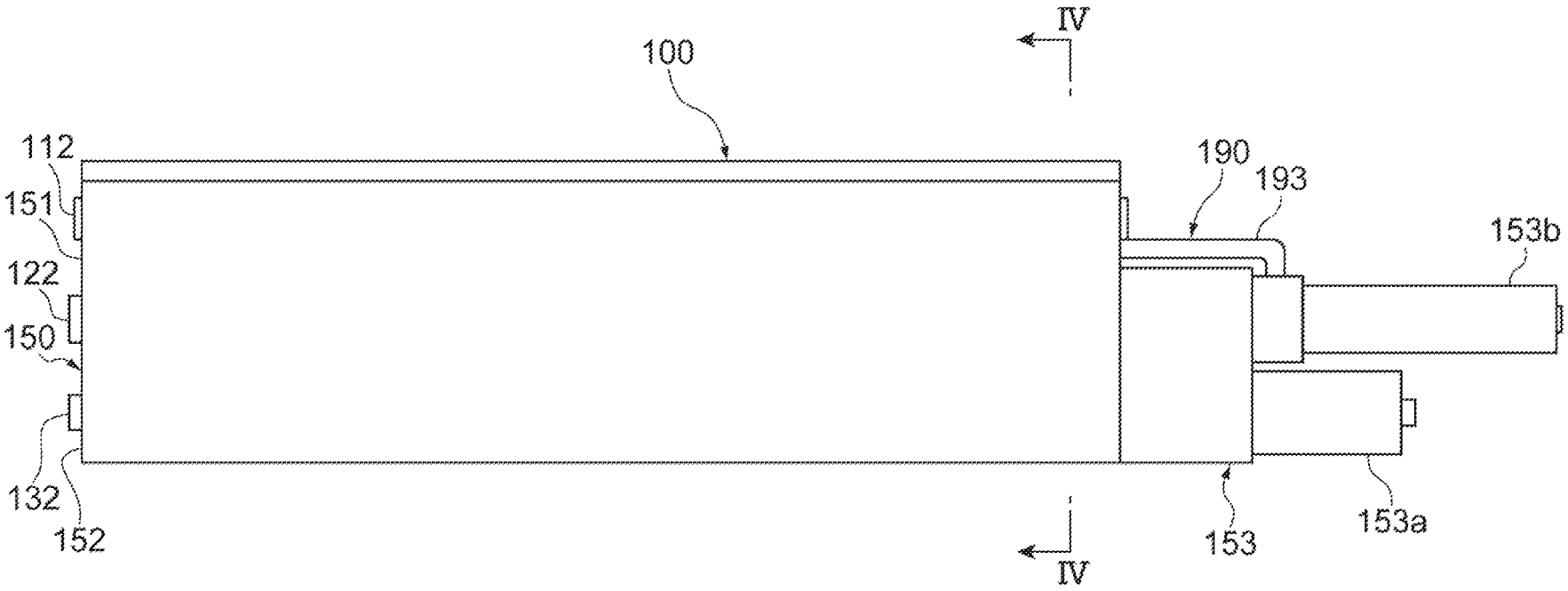
FIG. 2 is a schematic diagram illustrating a configuration of an example developing device.
Figure 3:
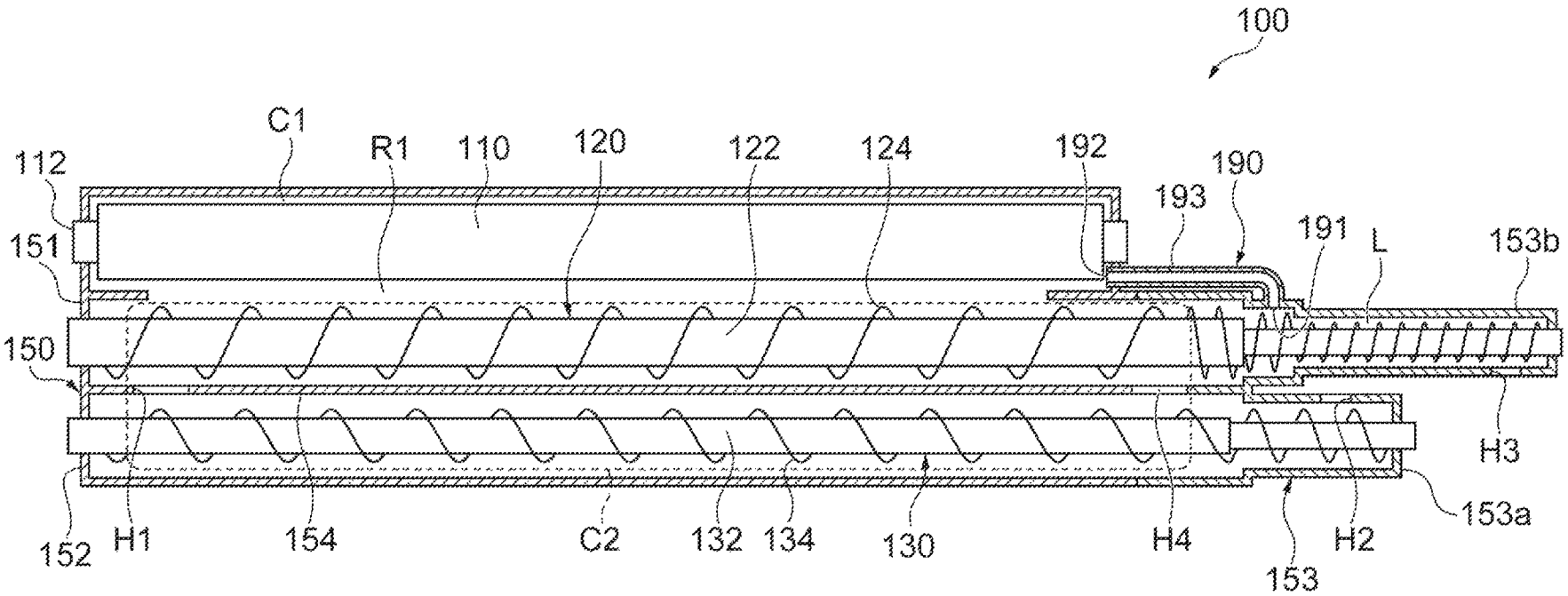
FIG. 3 is a schematic cross-sectional view illustrating an example internal configuration of the developing device of FIG. 2.
Figure 4:
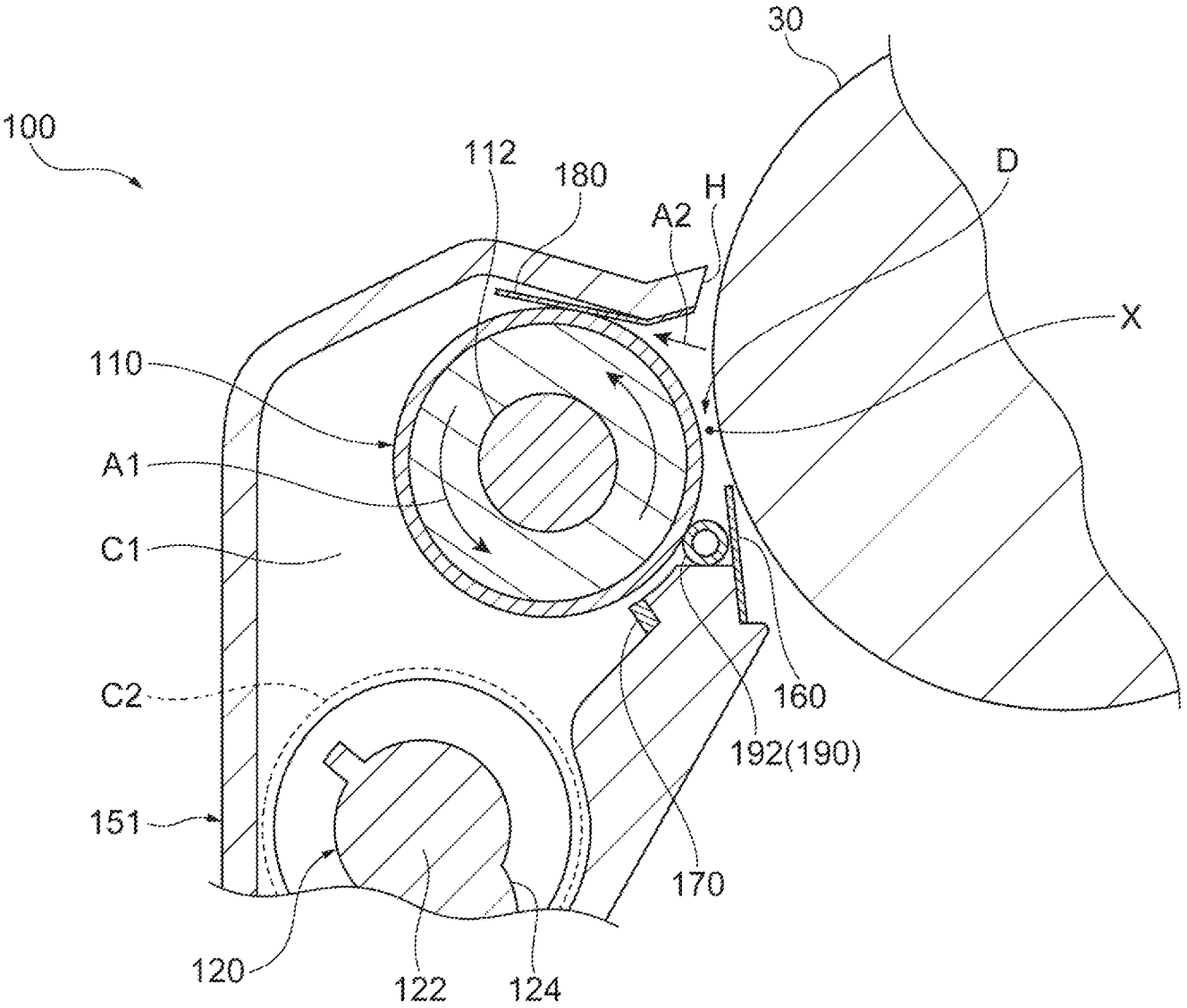
FIG. 4 is a schematic cross-sectional view of the developing device of FIG. 2 when taken along a line IV-IV.

The developing device 100 illustrated in FIGS. 2 to 4 may include, for example, a developing roller 110, a first conveying member (e.g., a toner supply conveying member) 120, and a second conveying member 130. The developing roller 110, the first conveying member 120, and the second conveying member 130 are located inside a casing 150 of the developing device 100.

A developing chamber C1 may be located at an upper portion inside the casing 150 (see FIG. 4). The developing roller 110 is located inside the developing chamber C1. The developing roller 110 is a developer carrying member that supplies (carries) a toner to the electrostatic latent image formed on the peripheral surface of the photosensitive drum 30.

A first conveying member 120 and a second conveying member 130 are located below the developing roller 110. The first conveying member 120 and the second conveying member 130 frictionally charge the carrier and the toner by stirring a magnetic carrier and a non-magnetic toner constituting the developer inside the casing 150.

The casing 150 includes, for example, a first casing portion 151, a second casing portion 152, and a third casing portion 153. The first casing portion 151 accommodates the developing roller 110 and the first conveying member 120. The second casing portion 152 accommodates the second conveying member 130. The third casing portion 153 is connected to the end portions of the first casing portion 151 and the second casing portion 152. The third casing portion 153 accommodates the end portions of the first conveying member 120 and the second conveying member 130.

The developing roller 110 includes, for example, a rotary shaft 112. Both end portions of the rotary shaft 112 are rotatably supported by, for example, the first casing portion 151.

The first conveying member 120 supplies the developer to the developing roller 110 while conveying the mixed and stirred developer. The first conveying member 120 includes, for example, a first support shaft 122 and a first conveying blade 124. The first support shaft 122 is rotatably supported by the first casing portion 151 and the third casing portion 153. The first conveying blade 124 may be located on the outer peripheral surface of the first support shaft 122. The first conveying blade 124 includes a spiral inclined surface which is located along the longitudinal direction of the first support shaft 122.

The second conveying member 130 is in charge of sufficiently charging the developer by mixing and stirring the developer. The second conveying member 130 conveys the charged developer to the first conveying member 120. Similar to the first conveying member 120, the second conveying member 130 includes, for example, a second support shaft 132 and a second conveying blade 134. The second support shaft 132 is rotatably supported by the second casing portion 152 and the third casing portion 153. The second conveying blade 134 may be located on the outer peripheral surface of the second support shaft 132. The second conveying blade 134 includes a spiral inclined surface which is located along the longitudinal direction of the second support shaft 132.

For example, the first conveying member 120 and the second conveying member 130 are arranged so that the first support shaft 122 and the second support shaft 132 are substantially parallel to each other. The first casing portion 151 and the second casing portion 152 are located adjacent to each other in a substantially vertical direction. In this example, a lower portion of the first casing portion 151 and an upper portion of the second casing portion 152 are formed as one member (hereinafter, referred to as a "partition plate 154"). The partition plate 154 may also function as a part of the first casing portion 151 and a part of the second casing portion 152. The partition plate 154 divides the first conveying member 120 and the second conveying member 130 from each other. The partition plate 154 may be configured with an opening portion H1. The opening portion H1 may be located in the vicinity of an end portion opposite to an end portion supported by the third casing portion 153 in the first conveying member 120. The opening portion H1 delivers the developer from the inside of the second casing portion 152 into the first casing portion 151.

The developer which is conveyed while being stirred by the second conveying member 130 inside the second casing portion 152 is sent into the first casing portion 151 through the opening portion H1. The first conveying blade 124 of the first conveying member 120 conveys the developer from the opening portion H1 toward the third casing portion 153 while stirring the developer. While the developer is conveyed by the first conveying member 120, a part of the developer moves to the peripheral surface of the developing roller 110. In this way, the first conveying member 120 supplies the developer to the developing roller 110 while conveying the developer. The remaining developer which does not move to the peripheral surface of the developing roller 110 is sent from the inside of the first casing portion 151 into the third casing portion 153.

The third casing portion 153 includes, for example, an inlet path forming portion 153*a* and a developer discharge path forming portion 153*b*. The inlet path forming portion 153*a* accommodates an end portion of the second conveying member 130 and supports the end portion. The inlet path forming portion 153*a* may be configured with a developer supply port H2. A replenishment developer is supplied from the developer supply unit into the inlet path forming portion 153*a* through the developer supply port H2. The replenishment developer which is supplied into the inlet path forming portion 153*a* passes through the inlet path forming portion 153*a* and is sent into the second casing portion 152.

The developer discharge path forming portion 153*b* accommodates an end portion of the first conveying member 120 and supports the end portion. The developer discharge path forming portion 153*b* may be configured with a developer discharge port H3. The developer discharge port H3 discharges the developer which is degraded by a printing operation to the outside of the casing 150 by using a change in volume of the developer inside the casing 150. In this way, a space inside the developer discharge path forming portion 153*b* functions as a developer discharge path L including the developer discharge port H3 discharging the developer.

The third casing portion 153 may be configured with, for example, an opening portion H4 which connects a space inside the inlet path forming portion 153*a* to a space inside the developer discharge path forming portion 153*b*. The developer which is sent from the first casing portion 151 into the developer discharge path forming portion 153*b* is sent into the inlet path forming portion 153*a* through the opening portion H4 and is further sent into the second casing portion 152.

In this way, a conveying path C2 through which the developer is circulated and conveyed by the first conveying member 120 and the second conveying member 130 may be located between the opening portion H1 and the opening portion H4 inside the first casing portion 151, the second casing portion 152, and the third casing portion 153. In FIGS. 3 and 4, a range of the conveying path C2 is indicated by a dashed line. The developer discharge path L located inside the developer discharge path forming portion 153*b* is connected to the conveying path C2. Accordingly, the developer discharge path L can discharge developer which underwent a printing operation to the outside of the developing device 100.

Inside the casing 150, the conveying path C2 is located adjacent to the lower side of the developing chamber C1. In the conveying path C2, a portion formed inside the first casing portion 151 communicates with the developing chamber C1 in the vertical direction. Accordingly, the conveying path C2 can circulate the developer and to supply the developer to the developing roller 110.

As illustrated in FIGS. 2 and 4, the developing roller 110 of this example rotates about, for example, a rotation axis of the rotary shaft 112 in a direction indicated by an arrow A1 in FIG. 4. The first casing portion 151 of the casing 150 may be configured with an opening portion H extending along the rotary shaft 112 of the developing roller 110. The developing roller 110 faces the photosensitive drum 30 through the opening portion H. The developing roller 110 moves the toner of the developer to the photosensitive drum 30 in a movement region D which is a region between the developing roller 110 and the photosensitive drum 30 and includes a closest approach position X (or point of closest approach) in which the developing roller 110 is closest to the photosensitive drum 30.

A regulation member 170 may be located at a position which is located at the upstream side of the closest approach position X and is adjacent to the developing roller 110. Furthermore, the upstream side herein indicates the upstream side of the developing roller 110 in the rotational direction. Similarly, the downstream side is set to the downstream side of the developing roller 110 in the rotational direction. The regulation member 170 restricts the thickness of the developer carried by the developing roller 110. The regulation member 170 may be attached to, for example, the inner surface of the first casing portion 151.

The opening portion H of the first casing portion 151 may be configured with a first seal member 160. The first seal member 160 may be located at the upstream side of the developing roller 110 in the rotational direction in relation to the closest approach position X. An end portion at the upstream side of the first seal member 160 (the upstream side of the developing roller 110 in the rotational direction) is fixed to an edge portion of the opening portion H of the first casing portion 151 (the casing 150). An end portion at the downstream side of the first seal member 160 (the downstream side of the developing roller 110 in the rotational direction) extends toward the closest approach position X between the developing roller 110 and the photosensitive drum 30. A front end portion (a downstream end portion) of the first seal member 160 is in contact with the developer (the toner) carried by the developing roller 110 in the movement region D.

In some examples, the opening portion H of the first casing portion 151 may be configured with a second seal member 180. The second seal member 180 is located between the upper portion of the developing roller 110 and the lower surface of the upper portion of the first casing portion 151. The developing device 100 includes the second seal member 180 which may be located between the developing roller 110 and the casing 150 at the downstream position of the closest approach position X. The second seal member 180 may comprise an elastic member. The second seal member 180 may extend along the extension direction of the developing roller 110. An upstream end portion of the second seal member 180 may be attached to the inner surface of the upper portion of the first casing portion 151. The second seal member 180 may be in slidable contact with the outer peripheral surface of the upper portion of the developing roller 110. In some examples, the developing device 100 can increase the sealability and airtightness of the developing device 100 by the second seal member 180.

As illustrated in FIG. 2 to FIG. 4, the developing device 100 may be configured with a discharge path 190 which discharges air from the developing chamber C1. The discharge path 190 may comprise a tubular member having a flow passage formed therein. The discharge path 190 includes an inlet 191, an outlet 192, and an intermediate portion 193. The intermediate portion 193 may be located between the inlet 191 and the outlet 192.

The inlet 191 of the discharge path 190 is connected to the casing 150 and communicates with a space inside the casing 150. The inlet 191 communicates with the developing chamber C1 in the casing 150. The inlet 191 is located at a portion outside the conveying path C2. In some examples, the inlet 191 is located at the developer discharge path L which is outside the conveying path C2 and communicates with the developer discharge path L (see FIG. 3). The inlet 191 is connected to the developing chamber C1 through the developer discharge path L and the conveying path C2.

The outlet 192 of the discharge path 190 is located between the developing roller 110 and the photosensitive drum 30. The outlet 192 may be located at the upstream position in relation to the closest approach position X of the developing roller 110 and the photosensitive drum 30. In some examples, the outlet 192 is located at a position between the developing roller 110 and the photosensitive drum 30 and a position between the upstream side of the closest approach position X and the downstream side of the regulation member 170.

Figure 5:
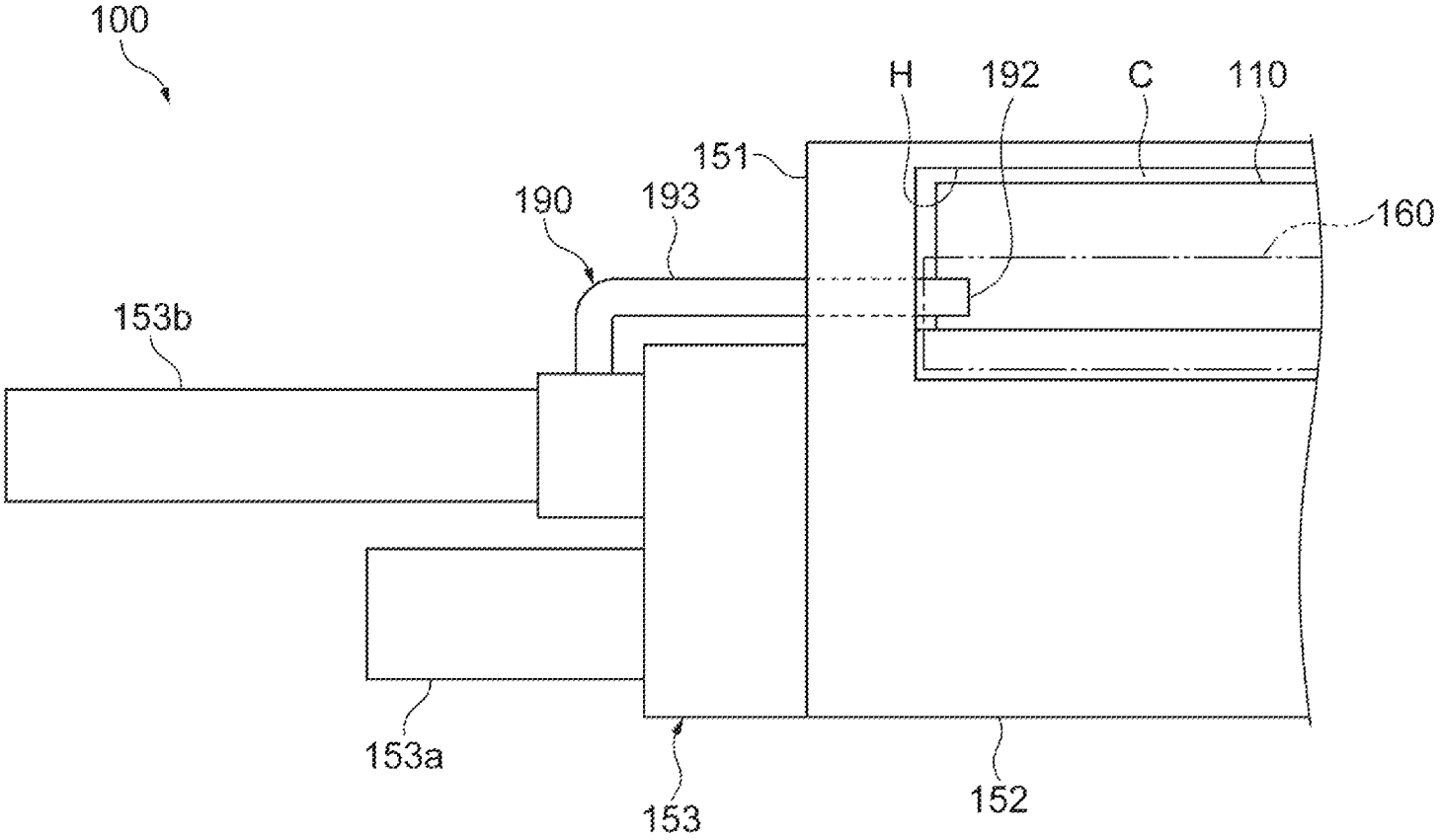
FIG. 5 is a schematic diagram illustrating the developing device of FIG. 2.

The outlet 192 extends to a position facing the outer peripheral surface (the developer storage portion) of the developing roller 110 as illustrated in FIG. 5. As illustrated in FIGS. 4 and 5, the outlet 192 may be located between the developing roller 110 and the first seal member 160. Furthermore, the first seal member 160 is indicated by a virtual line (a two-dotted chain line) in order to show the position of the outlet 192 in FIG. 5.

The intermediate portion 193 connects the inlet 191 and the outlet 192 to each other. The intermediate portion 193 is located outside the casing 150. In some examples, the intermediate portion 193 passes through the outside of the casing 150. Furthermore, at least a part of the intermediate portion 193 may pass through the outside of the casing 150. Depending on the installation positions of the inlet 191 and the outlet 192, a part of the intermediate portion 193 may penetrate the casing 150. Additionally, a concave portion or the like may be located in the casing 150 to avoid interference with the intermediate portion 193 depending on the installation positions of the inlet 191 and the outlet 192.

As illustrated in FIG. 4, air may be taken into the first casing portion 151 as indicated by an arrow A2 from a gap between the developing roller 110 and the first casing portion 151, for example, at the downstream position in relation to the closest approach position X when the developing roller 110 rotates. Accordingly, a pressure (e.g., an air pressure) of the casing 150 increases. Since a pressure inside the casing 150 increases, air inside the casing 150 is sent from the developer discharge path L into the discharge path 190 through the inlet 191 and is discharged to a position between the developing roller 110 and the photosensitive drum 30 through the outlet 192 as illustrated in FIGS. 3 and 4.

In some examples, the developing device 100 may include the discharge path 190 which discharges air inside the casing 150 to a position between the developing roller 110 and the photosensitive drum 30. Accordingly, the developing device 100 may be configured to suppress an increase in pressure inside the casing 150 and to suppress the developer from being scattered from a portion having low sealability and airtightness. Further, when the developing device 100 includes the discharge path 190 which suppresses an increase in pressure inside the casing 150, the amount of developer which is discharged from the developer discharge port H3 may be suppressed, restricted, limited or otherwise controlled when there is an increase in pressure inside the casing 150.

The inlet 191 of the discharge path 190 may be located outside the conveying path C2 through which the developer is circulated and conveyed. Accordingly, the amount of the developer flowing into the discharge path 190 may be decreased when an air stream flows from the inlet 191 into the discharge path 190 with an increase in pressure inside the casing 150. Thus, the developing device 100 can suppress the developer from being discharged from the casing 150 when discharging air inside the casing 150.

The outlet 192 of the discharge path 190 may be located at the upstream position in relation to the closest approach position X between the developing roller 110 and the photosensitive drum 30. Accordingly, the developing device 100 may be configured to hold the developer included in the air discharged from the outlet 192 on the developing roller 110 or to move the developer to the photosensitive drum 30.

The developing device 100 includes the first seal member 160. The outlet 192 of the discharge path 190 is located between the developing roller 110 and the first seal member 160. In some examples, the developing device 100 may be configured to suppress the scattering of the developer included in the air discharged from the outlet 192 of the discharge path 190. The front end portion of the first seal member 160 is in contact with the developer carried by the developing roller 110. Further, a downstream end portion of the first seal member 160 may be fixed to the casing. Accordingly, the developing device 100 may be configured to close a space between the first seal member 160 and the developing roller 110 and to further suppress the scattering of the developer included in the air discharged from the outlet 192 of the discharge path 190.

The inner diameter of the discharge path 190 may be larger than the diameter of the developer discharge port H3. In some examples, the developing device 100 may be configured to suppress the amount of the developer discharged from the developer discharge port H3 along the air stream generated with an increase in pressure inside the casing 150.

The example developing device 100, or operation thereof, may be modified. For example, the inlet 191 of the discharge path 190 may not be located in the developer discharge path L. By way of further example, and similar to the developing device 100A illustrated in FIGS. 6 and 7, an inlet 191A of a discharge path 190A may be located in the vicinity of the developing roller 110 in the first casing portion 151 and may communicate with the developing chamber C1 inside the first casing portion 151. In some examples, the inlet 191A is located outside the conveying path C2. Accordingly, a similar functionality as that of the discharge path 190 may be obtained for imaging systems including the discharge path 190A.

Figure 8:
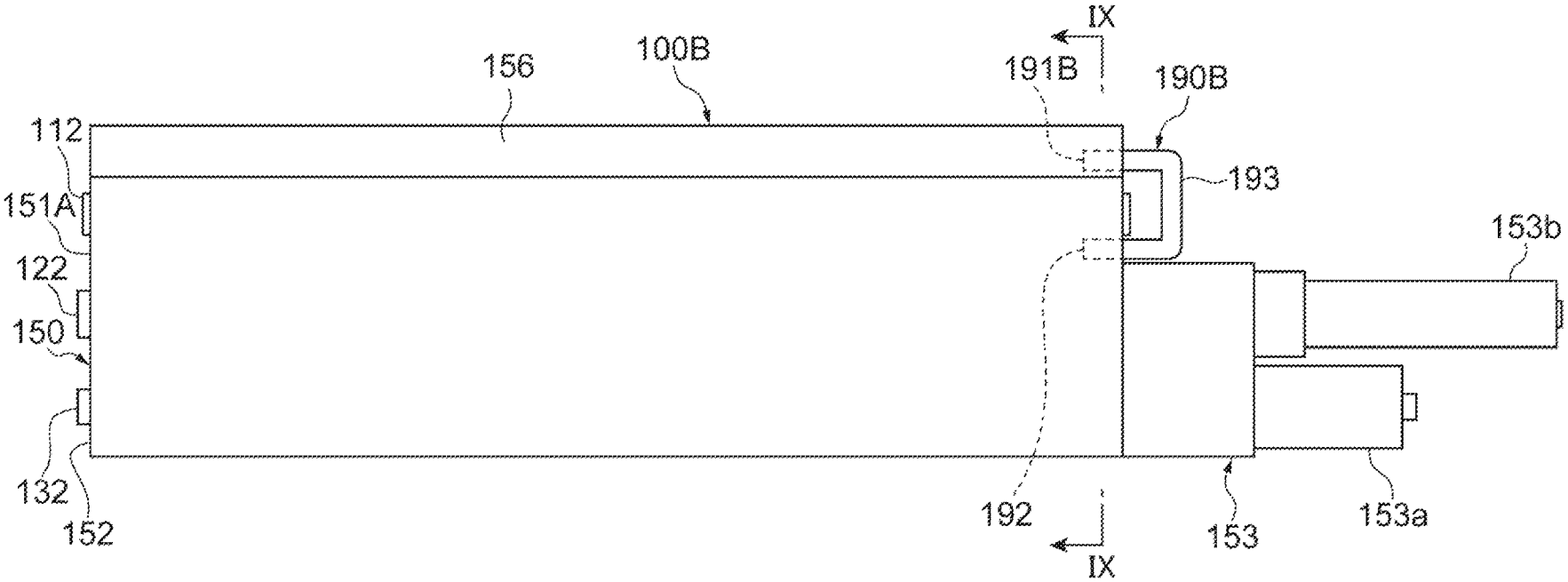
FIG. 8 is a schematic diagram illustrating a configuration of still another example developing device.
Figure 9:
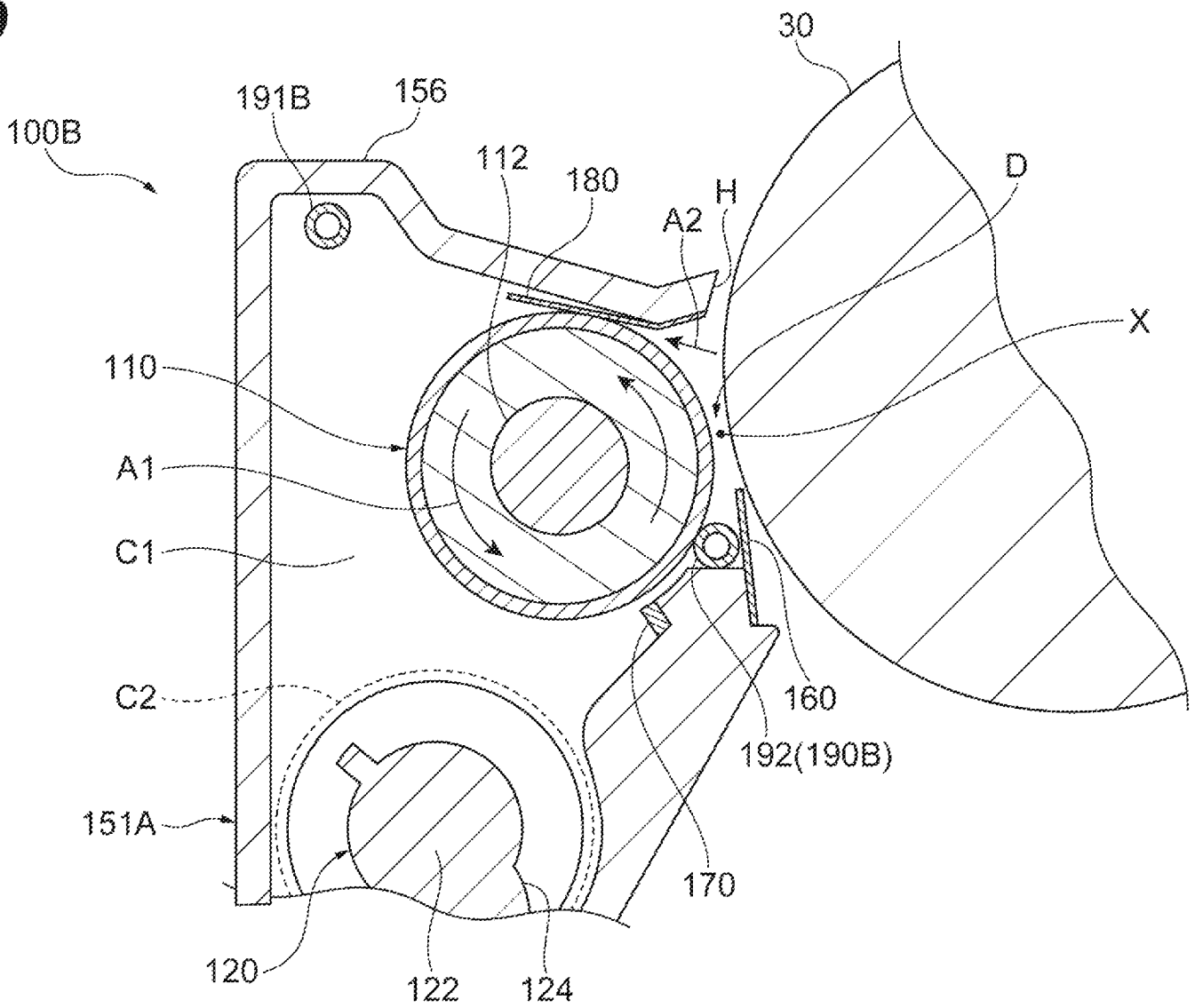
FIG. 9 is a schematic cross-sectional view of the developing device of FIG. 8 when taken along a line IX-IX.

As illustrated in FIGS. 8 and 9, an example developing device 100B may include a first casing portion 151A with a raised portion 156. The raised portion 156 is located above the developing roller 110 and may be located along the extension direction of the developing roller 110. The raised portion 156 widens the range of the developing chamber C1 upward. In some examples, an inlet 191B of a discharge path 190B may be connected to an end portion on the side of the third casing portion 153 in the raised portion 156 and may communicate with the developing chamber C1. The inlet 191B may be located above the developing roller 110 in a posture of the developing device 100 when the developing roller 110 moves the developer to the photosensitive drum 30. In examples in which the inlet 191B may be located outside the conveying path C2, a similar functionality may be achieved as that of the discharge path 190. Further, by locating the inlet 191B above the developing roller 110, the developing device 100B may be configured to suppress the amount of the developer entering the discharge path 190B from the developing chamber C1.

The example discharge paths 190A and 190B which are described with reference to FIGS. 6 to 9 are located at the end portions connected to the third casing portion 153 in the first casing portions 151 and 151A. However, in other examples, the discharge paths 190A and 190B may be located at the end portions opposite to the end portions connected to the third casing portion 153 in the first casing portions 151 and 151A.

Figure 10:
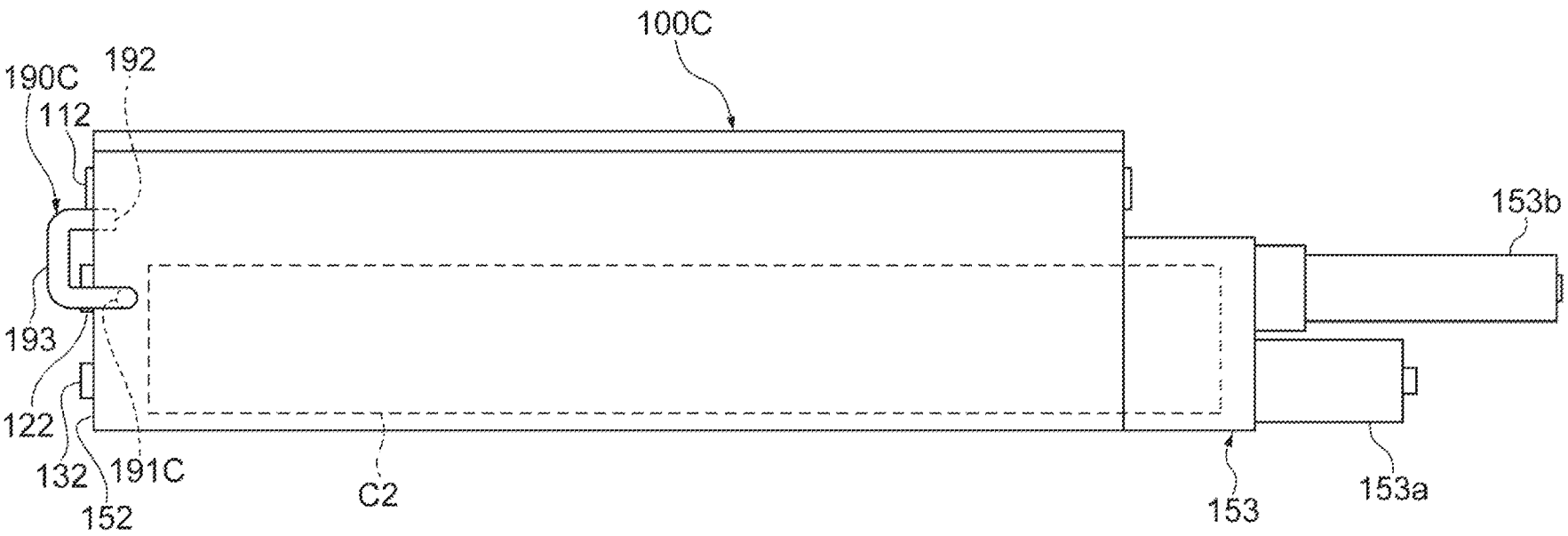
FIG. 10 is a schematic diagram illustrating a configuration of still another example developing device.

As illustrated in FIG. 3, for example, an upstream end portion of the first conveying member 120 in the developer conveying direction (in FIG. 3, a left end portion of the first conveying member 120) is located outside the conveying path C2. Similar to an example developing device 100C illustrated in FIG. 10, an inlet 191C of a discharge path 190C may communicate with a space inside the casing 150 at a position outside the conveying path C2 and a position of the upstream side of the first conveying member 120 in the developer conveying direction. In examples in which the inlet 191C is located outside the conveying path C2, a similar functionality may be achieved as that of the discharge path 190.

Figure 6:
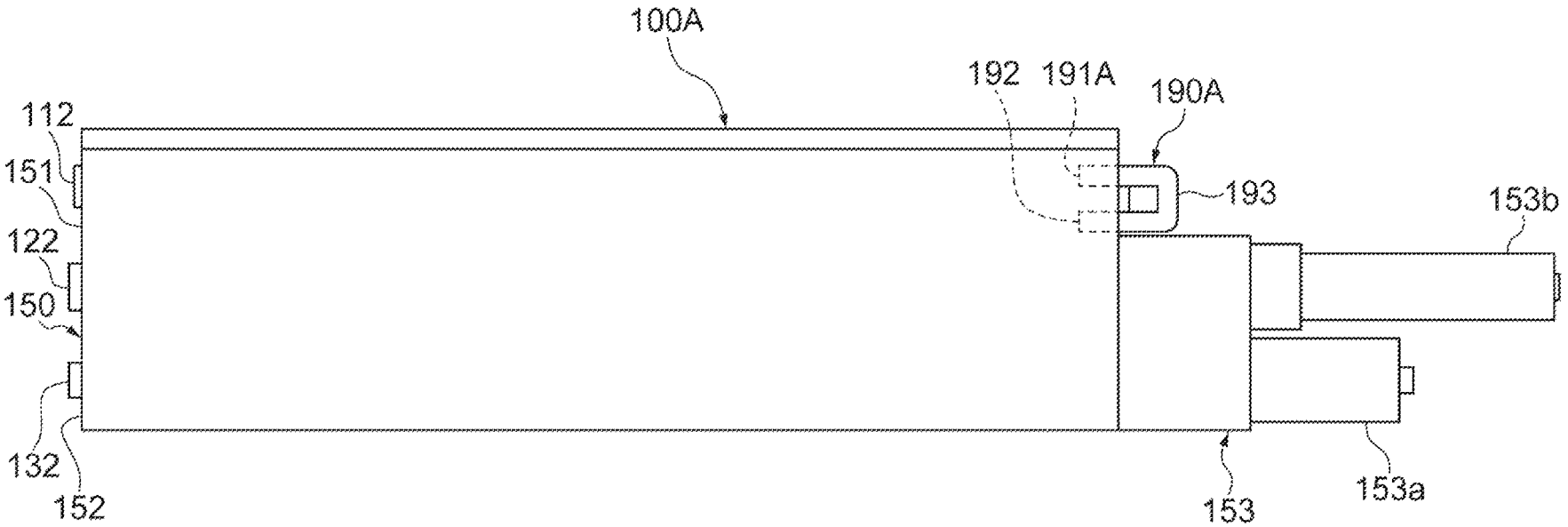
FIG. 6 is a schematic diagram illustrating a configuration of another example developing device.
Figure 7:
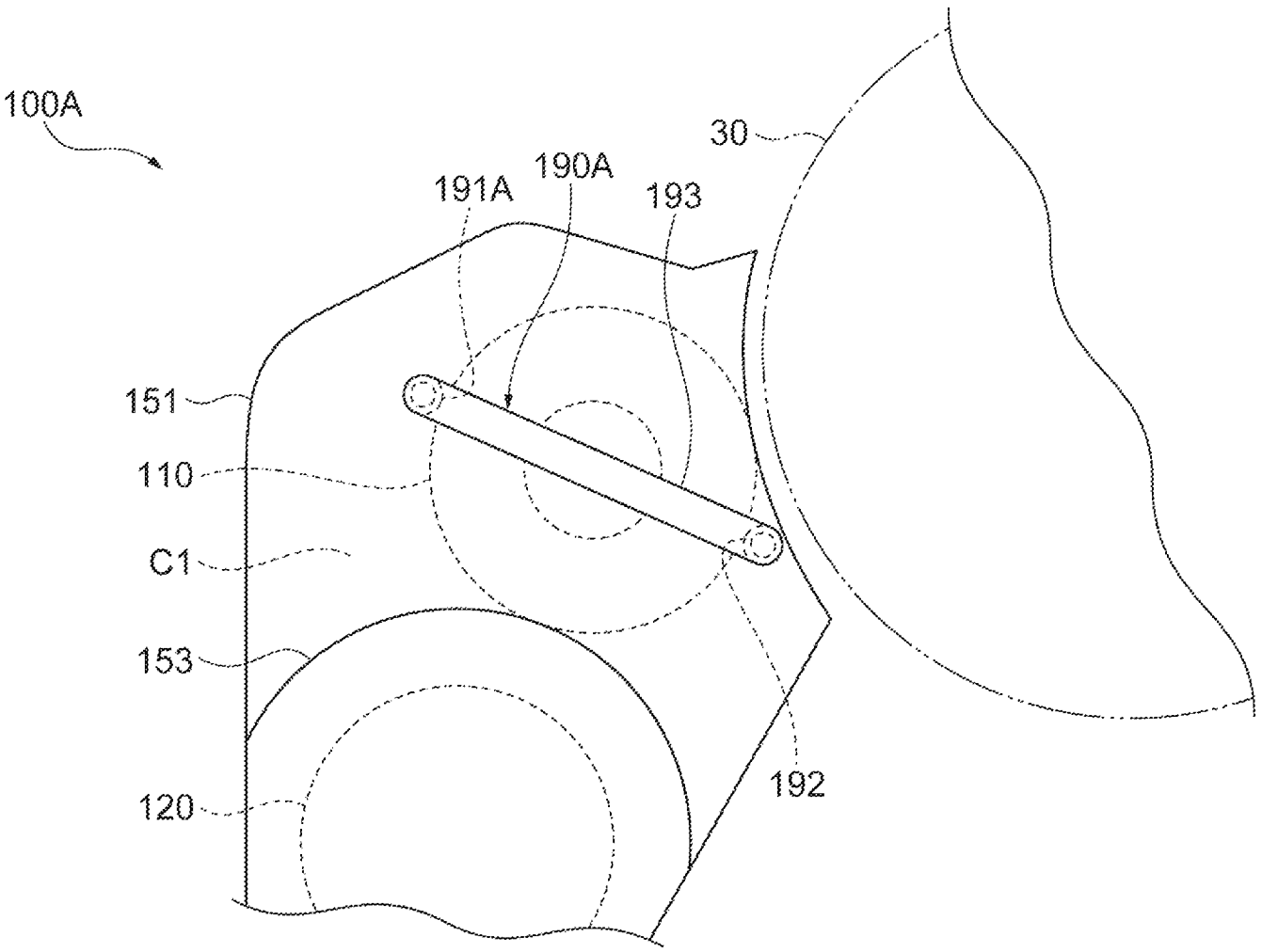
FIG. 7 is a schematic diagram illustrating another example developing device.

The inlet of the discharge path may be connected to an end surface of the developing roller 110 in the extension direction of the casing 150 similar to the inlet 191A illustrated in FIG. 6. In other examples, the inlet of the discharge path may be connected to a surface other than an end surface of the developing roller 110 in the extension direction of the casing 150, similar to the inlet 191C illustrated in FIG. 10.

Figure 11:
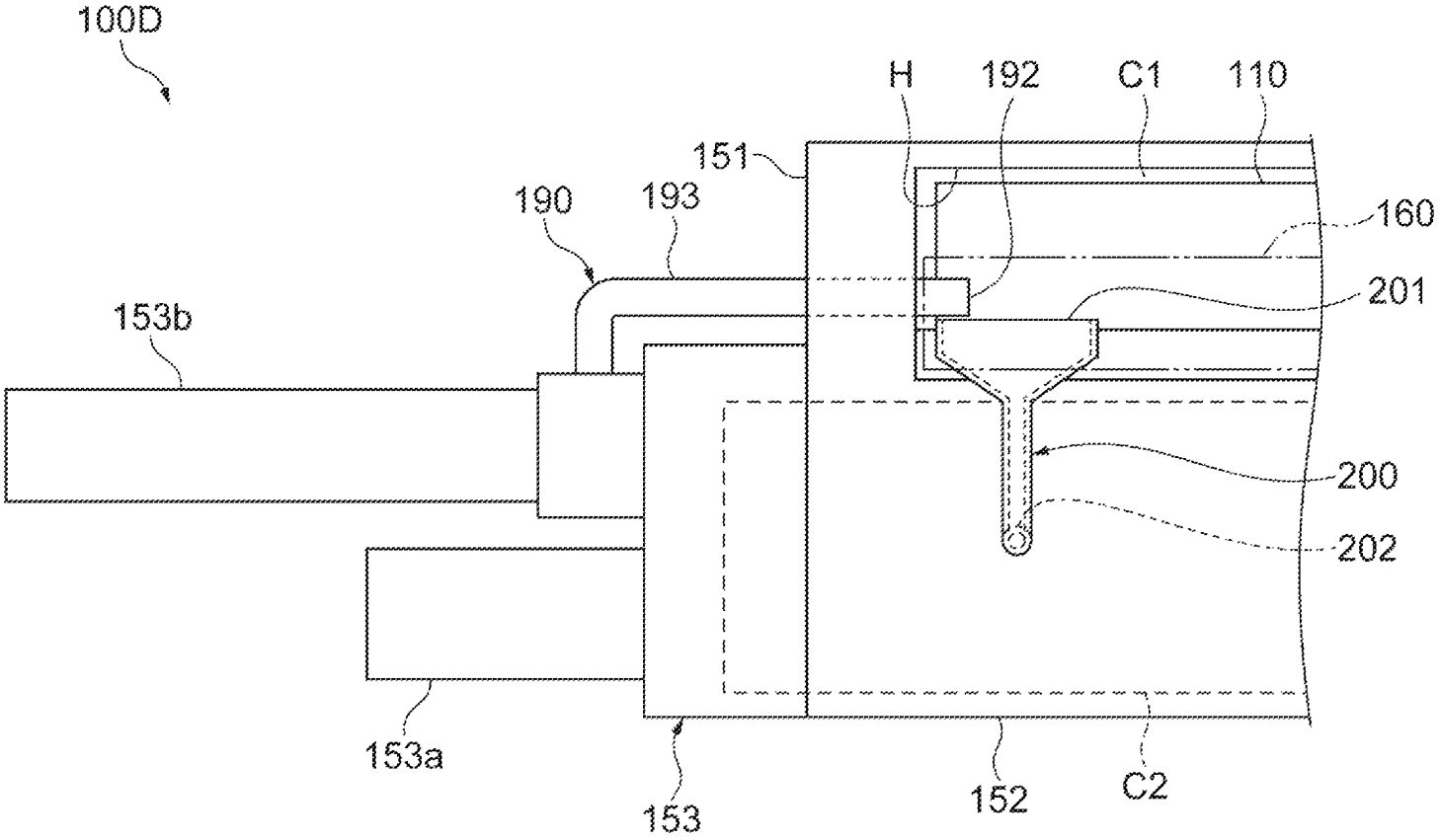
FIG. 11 is a schematic diagram illustrating yet another example developing device.

As illustrated in FIG. 11, a developing device 100D may include a bypass flow passage 200. The bypass flow passage 200 may comprise a tubular member having a flow passage formed therein. The bypass flow passage 200 collects the developer discharged from the discharge path 190 along with air and returns the developer to the conveying path C2.

In some examples, the bypass flow passage 200 includes a bypass flow passage inlet 201 and a bypass flow passage outlet 202. The bypass flow passage inlet 201 may be located below the outlet 192 of the discharge path 190 between the developing roller 110 and the photosensitive drum 30. The bypass flow passage inlet 201 faces the outlet 192 (the upper side). The shape of the bypass flow passage inlet 201 may be configured to receive the developer discharged from the outlet 192 of the discharge path 190. Similar to the outlet 192 of the discharge path 190 illustrated in FIG. 4, the bypass flow passage inlet 201 may be located between the developing roller 110 and the first seal member 160. The bypass flow passage outlet 202 is connected to the casing 150 and communicates with the conveying path C2 inside the casing 150.

In some examples, the bypass flow passage 200 may be configured to collect the developer discharged from the outlet 192 of the discharge path 190 along with air by the bypass flow passage inlet 201 and to return the developer to the conveying path C2 again. Accordingly, the developing device 100D can suppress, limit, restrict or otherwise control a decrease in the amount of the developer inside the casing 150.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. An imaging system comprising:

a casing including a developing chamber;

a developing roller located inside the developing chamber to carry a toner to a photoreceptor;

a conveying path located adjacent to the developing chamber and inside the casing to circulate the toner and to supply the toner to the developing roller;

a seal member between the developing roller and the photoreceptor; and an air discharge path comprising:

an inlet located outside the conveying path, the inlet to communicate with the developing chamber in the casing, an outlet located between the developing roller and the photoreceptor, and located between the developing roller and the seal member, the outlet to discharge air to a position between the developing roller and the photoreceptor, and an intermediate portion located outside the casing between the inlet and the outlet.

2. The imaging system according to claim 1, wherein the outlet is located upstream, in a rotational direction of the developing roller, of a point of closest approach between the developing roller and the photoreceptor.

3. The imaging system according to claim 2, wherein the seal member is located upstream of the point of closest approach.

4. The imaging system according to claim 3, wherein a front end portion of the seal member is in contact with the toner carried by the developing roller.

5. The imaging system according to claim 3, wherein a downstream end portion of the first seal member is fixed to the casing.

6. The imaging system according to claim 1, comprising:

a developer discharge path connected to the conveying path, the developer discharge path including a developer discharge port to discharge at least a portion of the toner outside of the casing, wherein the inlet is located in the developer discharge path.

7. The imaging system according to claim 6, wherein an inner diameter of the developer discharge path is greater than a diameter of the developer discharge port.

8. The imaging system of claim 6, wherein the air discharge path extends from the developer discharge path to the position between the developing roller and the photoreceptor.

9. The imaging system according to claim 1, wherein the inlet is located in the casing at one end of the developing roller.

10. The imaging system according to claim 1, wherein the inlet is located above the developing roller when the developing roller moves the toner to the photoreceptor.

11. The imaging system according to claim 1, comprising:

a toner supply conveying member located inside the conveying path to supply the toner to the developing roller, wherein the inlet is located in the casing at an upstream end of the toner supply conveying member.

12. The imaging system according to claim 1, comprising:

a second seal member that is located between the developing roller and the casing downstream of a point of closest approach between the developing roller and the photoreceptor.

13. The imaging system according to claim 12, wherein an upstream end portion of the second seal member is attached to the casing.

14. The imaging system according to claim 12, wherein the second seal member is in slidable contact with an outer peripheral surface of the developing roller.

15. The imaging system according to claim 1, comprising:

a bypass flow passage including a bypass flow passage inlet and a bypass flow passage outlet, wherein the bypass flow passage inlet is located below the outlet of the air discharge path between the developing roller and the photoreceptor, and wherein the bypass flow passage outlet is connected to the conveying path.

16. The imaging system of claim 1, wherein the air discharge path is U-shaped.

17. An imaging system comprising:

a casing including a developing chamber;

a developing roller located inside the developing chamber to carry a developer including a toner and to move the toner of the developer to a photoreceptor in a movement region located between the developing roller and the photoreceptor, the movement region including a point of closest approach between the developing roller and the photoreceptor;

a regulation member located upstream of the movement region, in a rotational direction of the developing roller, the regulation member inside the developing chamber and adjacent to the developing roller, the regulation member to regulate a thickness of the developer carried by the developing roller;

a conveying path located adjacent to the developing chamber in the casing, the conveying path to circulate the developer and to supply the developer to the developing roller;

a seal member between the developing roller and the photoreceptor; and an air discharge path comprising:

an inlet located outside the conveying path to communicate with the developing chamber in the casing, an outlet located between the developing roller and the photoreceptor, and located between the developing roller and the seal member, the outlet to discharge air to a position between the developing roller and the photoreceptor, and the outlet located upstream, in the rotational direction of the developing roller, of the point of closest approach and downstream, in the rotational direction of the developing roller, of the regulation member, and an intermediate portion located outside of the casing between the inlet and the outlet.

18. The imaging system of claim 17, wherein the air discharge path is U-shaped.

19. The imaging system of claim 17, comprising:

a developer discharge path connected to the conveying path, the developer discharge path including a developer discharge port to discharge at least a portion of the toner outside of the casing, wherein the inlet is located in the developer discharge path.

20. The imaging system of claim 19, wherein the air discharge path extends from the developer discharge path to the position between the developing roller and the photoreceptor.

* * * * *